US011266892B2

(12) United States Patent
Kinner

(10) Patent No.: US 11,266,892 B2
(45) Date of Patent: Mar. 8, 2022

(54) FLYING OBJECT WATER GAME

(71) Applicant: Omnigames, Inc., Colorado Springs, CO (US)

(72) Inventor: Michael Kinner, Colorado Springs, CO (US)

(73) Assignee: OMNIGAMES, INC., Colorado Springs, CO (US)

( * ) Notice: Subject to any disclaimer, the term of this patent is extended or adjusted under 35 U.S.C. 154(b) by 99 days.

(21) Appl. No.: 15/974,378

(22) Filed: May 8, 2018

(65) Prior Publication Data

US 2018/0333627 A1 Nov. 22, 2018

Related U.S. Application Data

(60) Provisional application No. 62/507,522, filed on May 17, 2017.

(51) Int. Cl.

| | |
|---|---|
| ***A63B 67/06*** | (2006.01) |
| ***F41J 1/10*** | (2006.01) |
| ***F41J 5/22*** | (2006.01) |
| ***F41J 5/18*** | (2006.01) |
| ***A63H 33/18*** | (2006.01) |
| ***F41J 5/24*** | (2006.01) |

(Continued)

(52) U.S. Cl.

CPC ..... *A63B 67/06* (2013.01); *A63H 33/185* (2013.01); *F41J 1/10* (2013.01); *F41J 5/18* (2013.01); *F41J 5/22* (2013.01); *F41J 5/24* (2013.01); *A63B 71/023* (2013.01); *A63B 2009/008* (2013.01); *A63F 2250/0407* (2013.01)

(58) Field of Classification Search

CPC ... A63B 67/06; A63B 67/00; F41J 5/18; F41J 5/24; F41J 5/22; F41J 1/10; A63G 33/00; A63G 31/007; A63H 33/18; A63F 2250/0407

See application file for complete search history.

(56) References Cited

U.S. PATENT DOCUMENTS 3,843,127 A 10/1974 Lack
4,243,220 A * 1/1981 Shelley ..... A63F 9/0079 273/458

(Continued)

FOREIGN PATENT DOCUMENTS

EP 2848290 A1 3/2015
KR 20100048575 A 5/2010

OTHER PUBLICATIONS

PCT Application Serial No. PCT/US2018/060729 filed Nov. 13, 2018; "Notification of Transmittal of the International Search Report and the Written Opinion of the International Searching Authority" dated Jan. 16, 2019.

(Continued)

*Primary Examiner* — Jeffrey S Vanderveen
(74) *Attorney, Agent, or Firm* — Martensen IP; Michael C. Martensen

(57) ABSTRACT

A flying object water game by which an object is thrown or tossed at a framework on which water emitting targets reside. A target framework includes one or more detachable water emitting targets. A first team defends the framework while a second team throws or tosses, from a predetermined distance, a flying object at the target framework and associated water emitting targets with the objective to hit and detach one or more targets from the framework.

12 Claims, 6 Drawing Sheets

(51) Int. Cl.
*A63B 71/02* (2006.01)
*A63B 9/00* (2006.01)

(56) References Cited

U.S. PATENT DOCUMENTS

| | | | | | |
|---|---|---|---|---|---|
| 4,909,518 | A | | 3/1990 | Erlandson et al. | |
| 5,382,028 | A | | 1/1995 | Sciandra et al. | |
| 5,540,610 | A | * | 7/1996 | Sneddon | A63H 33/18 446/236 |
| 5,586,767 | A | | 12/1996 | Bohland | |
| 5,779,240 | A | * | 7/1998 | Santella | F41B 9/0053 273/349 |
| 5,848,793 | A | | 12/1998 | Celis | |
| 6,149,488 | A | | 11/2000 | Stark | |
| 6,296,252 | B1 | | 10/2001 | Hubka | |
| 8,037,906 | B1 | | 10/2011 | Grillo | |
| 8,287,406 | B2 | | 10/2012 | Biederman et al. | |
| 9,108,094 | B2 | * | 8/2015 | Cello | A63B 63/00 |
| 2008/0121309 | A1 | | 5/2008 | Boise et al. | |
| 2010/0120559 | A1 | * | 5/2010 | Biederman | A63B 67/06 473/470 |

OTHER PUBLICATIONS

International Search Report and Written Opinion of the International Searching Authority; International Application No. PCT/US2018/032986; Applicant Omnigames, Inc.; dated Sep. 3, 2018.
Omnigames, Inc.; International Preliminary Report on Patentability; PCT International Application No. PCT/US2018/032986; dated Nov. 19, 2019.

* cited by examiner

FLYING OBJECT WATER GAME

RELATED APPLICATION

The present application relates to and claims the benefit of priority to U.S. Provisional Patent Application No. 62/507,522 filed 17 May 2017 which is hereby incorporated by reference in its entirety for all purposes as if fully set forth herein.

BACKGROUND OF THE INVENTION

Field of the Invention

Embodiments of the present invention relate, in general, to an outdoor game and more particularly to an outdoor water game that uses a water emitting structure having a plurality of targets.

Relevant Background

As seasons change and temperature rises outdoor activities become more and more prevalent. Children and adults alike enjoy outdoor games that are enjoyable and involve water to keep them cool and comfortable. Swimming pools, sprinklers and garden hoses are all means by which friends and families enjoy the summer months with aid of water and splashing.

Games that combine water and competition have long been a summer favorite. For the simple prices of a bag of balloons and a water source, an entire family can exercise their competitive will and demonstrate their throwing skills as a rewarding splash on an unsuspecting target signals a successful attack. Moreover, games with flying discs and objects thrown at targets offer the ability to develop and maintain fitness, agility, eye hand coordination, team building and camaraderie.

Outdoor games that combine a competitive objective, a degree of skill, camaraderie and water that provide relief to hot weather remain in demand. A need therefore exists for a game and its associated methodology for a flying object water game by which competitively participating in the game results in getting wet and wherein winning involves a certain degree of skill.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A flying object water game by which an object is thrown or tossed at a framework on which water emitting targets reside is hereafter described by way of example. The flying object water game of the present invention includes at least one target framework on which detachably resides one or more water emitting targets. A first team defends the framework while a second team throws or tosses, from a predetermined distance, a flying object at the target framework and associated water emitting targets with the objective to hit and detach one or more targets from the framework.

Posed behind the target framework, the first team stands ready to either catch any detached water emitting targets before they strike the ground, or catch the flying object in the event the flying object misses its mark. Points are assessed to the first team for any water emitting target they are able to detach from the target framework. And the second team gains points for catching the flying object in those instances in which the flying object misses its intended target, or when the second team is able to rescue a detached water emitting target before it strikes the ground. Multiple variations of the game described above are described hereafter along with descriptions of the flying objects, target framework and water emitting targets.

In one embodiment of the present invention a kit for a water emitting outdoor game includes at least one target framework, at least one water emitting target adapted to detachably interlock with the at least one target framework, and at least one object configured to be thrown by a person for detaching the at least one water emitting target from the target framework. In addition each water emitting target includes an releasable water vessel or reservoir that upon an impact from the flying object or striking the ground releases the enclosed water.

Additional features of the kit for a water emitting outdoor game include that the target framework is adapted to couple to a water source and the target framework is adapted to emit water responsive to being impacted by the object. The target framework of the invention is, in one embodiment, adapted to include a base, a vertical support structure connected to the base and adapted to couple with the water source, and a horizontal structure coupled to the vertical structure apart from the base and adapted to interlock with the water emitting targets and wherein the vertical structure and horizontal structure are adapted to transport water from the water source to the at least one water emitting targets.

Another feature of the kit of the present invention is that the target framework is adapted to supply water to the water vessel of the at least one water emitting target when the at least one water emitting target is interlocked with the target framework. In addition the target framework is configured to couple with an additional target framework to create even a larger target structure so that the game can involve larger groups of individuals rather than small teams.

In one embodiment of the present invention the object being tossed or thrown toward the target frameworks is a flying disk while in another embodiment of the present invention the object being thrown is one of the detachable targets, albeit already detached from the target framework.

Another embodiment of the present invention is a water emitting game apparatus coupled to a water source intended for use by at least two teams. In such an embodiment the target framework includes a base, a vertical support structure connected to the base that is adapted to couple with the water source, and a horizontal structure coupled to the vertical structure apart from the base.

The apparatus includes at least one water emitting target that is adapted to detachably interlock with the target framework. The water emitting target further includes a releasable water vessel that, upon impact from a flying object and detaching from the target framework, releases water from the release water vessel. A valve coupled to the target framework is adapted to supply water from the water source to the releasable water vessel within the water emitting target when interlocked with the target framework so that the targets can be recharged with water and, when detached, release a water spray for a predetermined period of time hitting any nearby players.

One feature of the present invention is that at least one water emitting target includes a male fitting and wherein the target framework includes a female fitting adapted to couple with the male fitting to interlock the at least one emitting target to the target framework. The fitting is further adapted to detach the at least one water emitting target in a predetermined direction upon impact from the flying object. Other means by which to detachably couple a water emitting target to the target framework are magnets, hook and loop combinations, compression fittings, and the like.

In yet another embodiment of the present invention, a method for playing a game by a first team and a second team having a water emitting game apparatus coupled to a water source begins by positioning the first team and the second team in a facing relation to one another and separated by a predetermined distance. A target framework is placed proximate with the first team and at least one water emitting target is detachably interlocked with the target framework. The game begins by tossing a flying object by the second team towards the target framework and the at least one water emitting target. The second team scores responsive to dislodging at least one water emitting target from the target framework by the flying object. And, the first team scores responsive to catching the dislodged water emitting target and/or the flying object.

In one version of the game the score for catching the "detached" object is larger than the score gained by hitting and detaching the object. Thus the team on the defense is motivated to remain close to the target framework.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1:
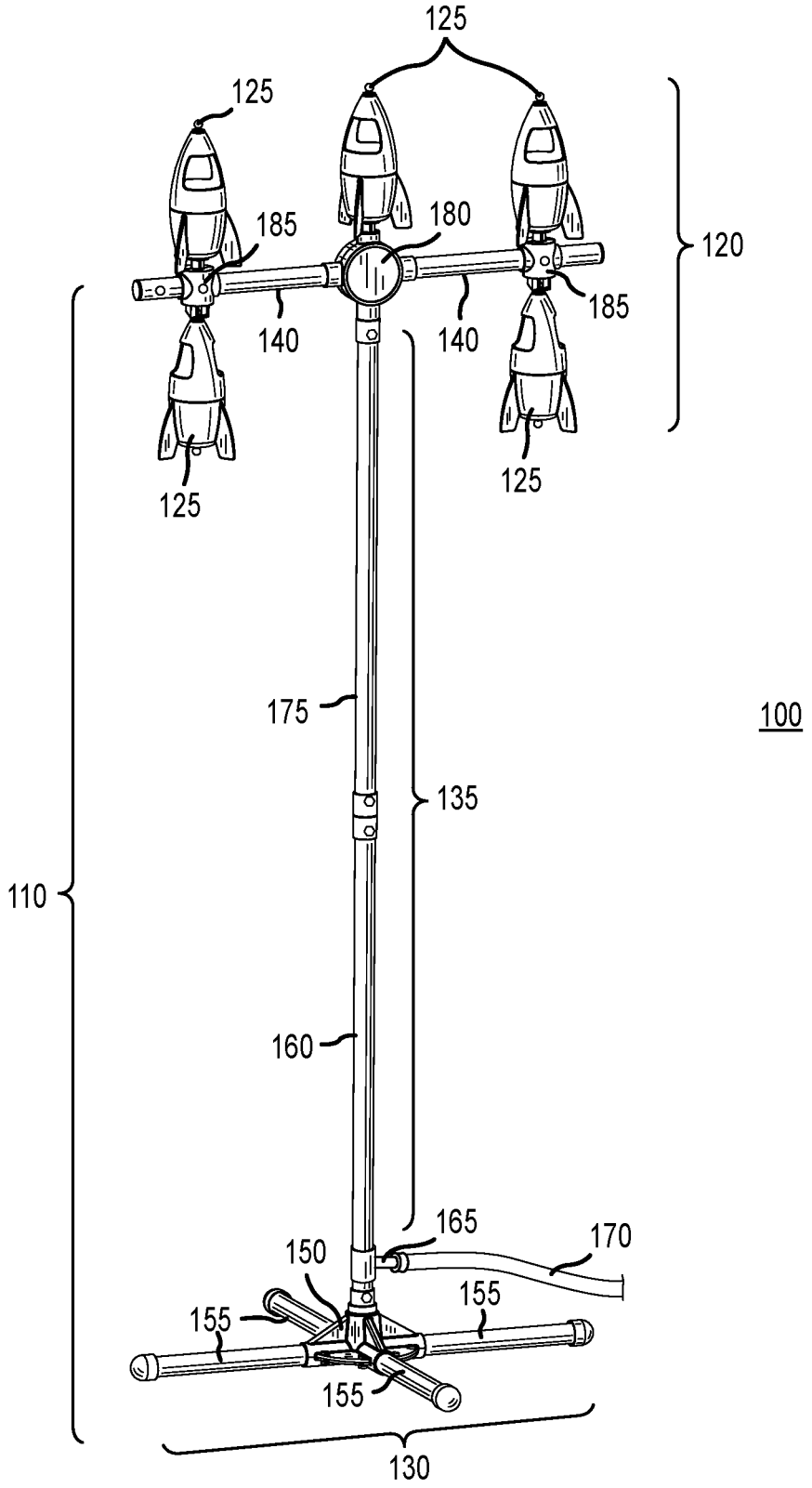
FIG. 1 is a perspective view of a water emitting game apparatus including a target framework and a plurality of water emitting targets, according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

The present invention combines a competitive objective, a degree of skill, eye-hand coordination, and camaraderie with water to provide fun relief to hot weather. The flying object water game of the present invention joins friendly competition among participants in a safe outdoor environment with water to craft an enjoyable and refreshing experience. A target framework, coupled to a water source, detachably retains at least one water emitting target. One team, set a predetermined distance away from the target framework, tosses an object such as a flying disk in an attempt to dislodge and detach the water emitting target from the framework. Concurrently, the opposing team stands by near the target framework to catch any dislodged water emitting target prior to its impact with the ground or, alternatively, catch the flying object when it misses the target entirely. Points are assessed to both teams based on their performance of assigned tasks.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Included in the description are flowcharts depicting examples of the methodology which may be used play a game using a water emitting target apparatus. It will also be understood that each block of the flowchart illustrations, and combinations of blocks in the flowchart illustrations, can be implemented by special purpose hardware that perform the specified functions or steps, or combinations of special purpose hardware to achieve the same result.

FIG. 1 presents a perspective view of one inventive embodiment for a water emitting game apparatus. The apparatus 100 is primarily comprised of a target framework 110 and a plurality of water emitting targets 125. In the embodiment shown in FIG. 1 the framework forms a "T" structure that can rest on the ground or, alternatively, be mounted to a support structure. The water emitting targets 125 shown in FIG. 1 are, in this embodiment, fashioned as rockets. In other embodiments the water emitting targets may have other shapes or appearances. For example in one version of the invention the targets may be cartoon characters, or objects representing sports teams or the like.

The target framework provides a stable platform on which to couple the water emitting targets. In this version of the invention, the target framework is comprised of several pieces of tubular pipe or conduit that are joined together to form a base 130, a vertical structure 135 and a horizontal structure 120 on which the water emitting targets 125 are detachable interlocked.

The components of the base can be assembled in a variety of configurations to provide a stable platform on which to support the associated vertical and horizontal structures. In this version a center mating unit 150 joins four balance arms 155 to a lower portion 160 of the vertical structure 135. Each balance arm is connected to the center mating unit 150 and is configured to extend away from the center mating unit 150 at approximately 90 degree angles from the other balance arms 155. As a result the combined balance arms when mated with the center mating unit form a "+" to provide uniform directional support for the water emitting targets.

In other embodiments the base can for a square, rectangle, triangle or other shapes that can provide similar stability for the target framework. And yet in other versions of the present invention the base may be omitted in favor of an inground support system in which the vertical structure couples to an existing inground permanent fixture. Similarly the center mating unit 150 can include a removable vertical spike extending downward that can aid in its stably for insertion in to grass, soil or similar soft surfaces underneath the center mating unit.

The version of the base shown in FIG. 1 present a symmetric configuration but as one of reasonable skill in the appropriate art will recognize other asymmetrical configurations can also be employed and indeed contemplated.

The base of the target framework is intend to reside on the ground or similar flat surface and support the connected vertical and horizontal structures. Accordingly, the vertical structure 135 is connected to the center mating unit 150 to and extend vertically away from the ground. In one embodiment of the present invention the vertical structure and the horizontal structure are hollow tubular sections that can be configured to transport water from the lower portion of the vertical structure to the horizontal structure and ultimately to each water emitting target. The lower portion of the vertical structure 160 includes a water source connection point 165 at which a water hose 170 or similar device can be coupled to the target framework to supply water. The water source connection point enables the vertical structure and the horizontal structure to be positively pressurized with water.

In the embodiment of the present invention shown in FIG. 1, there is a lower vertical structure 160, which includes the water source connection point 165, and an upper vertical structure 170. These two vertical structure components join to form the vertical structure as shown. The overall height of the target framework can be adjusted by adding additional vertical structure components.

Coupled to the top of the upper vertical structure is a horizontal structure link 180. The link 180 is configured to connect the vertical structure 135 with two opposing horizontal (cross) structure pieces 140. On each horizontal structure component 140 is at least one water emitting target connection point 185. At each connection point 185 a water emitting target 125 can detachably interlock with the horizontal structure 120. The link 180 and each horizontal structure piece 140 are adapted to transport water from the vertical structure 135 to each water emitting target connection point 185.

The version of the present invention shown in FIG. 1 presents a base 130, vertical structure 135 having two components 160, 175, an horizontal structure 120 comprised of two horizontal components 140 joined to the vertical structure 135 by a link 180. On the horizontal structure 120 are detachably interlocked five water emitting targets 125. In this version of the invention each water emitting target is the shape of a rocket and is fluidically coupled to the horizontal structure.

While the invention has been particularly shown and described with reference to embodiments, it will be understood by those skilled in the art that various other changes in the form and details may be made without departing from the spirit and scope of the invention.

Figure 2:
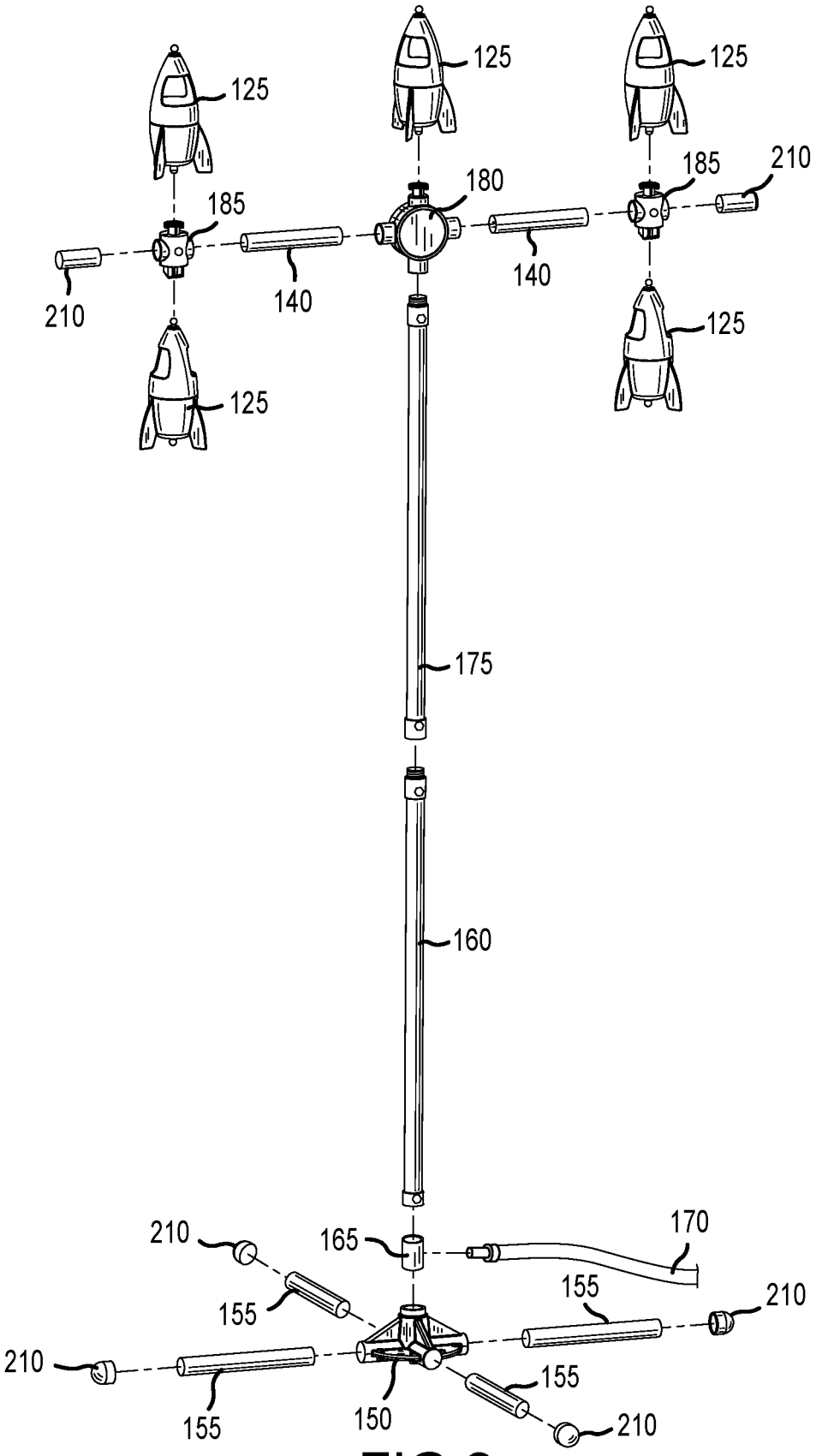
FIG. 2 is an exploded view of the water emitting game apparatus of FIG. 1, according to one embodiment of the present invention.

FIG. 2 is an explode view of the target framework and associated water emitting targets shown in FIG. 1. The exploded version of the target framework shows the tubular characteristic of the components as well as the caps 210 and the tees used to join the components together. While the based is, in this embodiment, composed of tubular components such as PVC pipe, in other embodiments the based may comprise rectangular or channel type structure that are equally capable of providing support. In this embodiment the vertical structure is adapted to transport water from the water source to the horizontal structure and ultimately to each water emitting target. Accordingly the base and the center mating unit need not be tubular or capable of transporting water.

FIG. 2 further illustrates the ease as which the target framework can be assembled and disassembled. Each balance component which joins at the center mating unit to form the base can quickly be assembled and dissembled to aid in the invention's ability to be stored and transported easily. Similarly the horizontal components can quickly be coupled to the horizontal link to complete the construction of the target framework.

The lower portion of the vertical structure includes a water source connection point 165 that includes a valve. The valve allows a user to determine whether water will comprise an element of the game when played and if so, to what degree. Each water emitting target 125 (as described in more detailed with reference to FIG. 3) are detachably interlocked with the horizontal structure. Each target is, in one embodiment, fluidically coupled to the horizontal structure at a target connection point. A valve within each connection point and with each water emitting target enables the target to be filled with water upon interlocking with the framework.

Upon being detached from the target framework the water within the water emitting target is free to disperse over any nearby participant. In another version of the present invention, the framework is not coupled to a water source and each water emitting target must be separately filled with water prior to being interlocked with the target framework. And in yet another embodiment, the target framework and the targets can be free of water entirely, for example on a cold day when getting wet may not be desirable.

Figure 3:
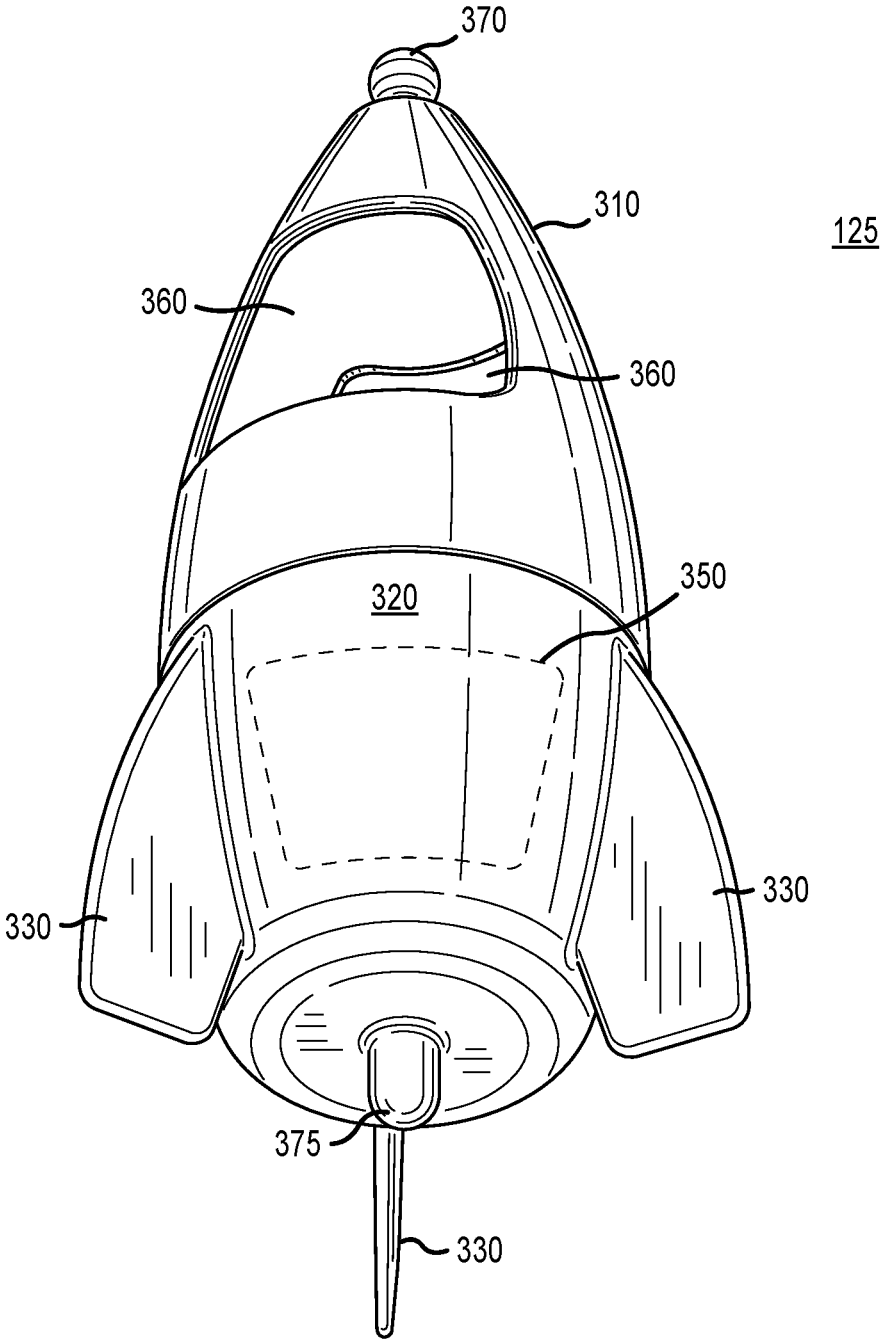
FIG. 3 is a perspective view a water emitting target apart from the target framework, according to one embodiment of the present invention.

Turning attention to FIG. 3, one can see, according to one embodiment of the present invention, a representative water emitting target 125 in the shape of a rocket. The target disclosed includes an upper rocket portion 310 and a lower rocket portion 320 with the lower rocket portion having a plurality of fins 330 for directional control when thrown. Within the rocket, and indeed within each water emitting target, is a water reservoir or water vessel 350. In one embodiment the water vessel is recharged (filled) with water upon interconnecting with the horizontal structure at a connection point. In other embodiments the water vessel is manually filled prior to use.

The upper rocket portion includes at least two windows 360 through which water can escape. The water vessel 350, which resides in the lower rocket portion, is dislodged upon the water emitting target becoming dislodged from the target framework. Once dislodged or detached from the target framework, water is free to spray on any nearby participants. In the instance in which the water emitting target is the object being tossed at the target framework, a participant catching the water emitting target in which the water vessel is full, is also likely to get wet.

In one embodiment of the present invention, the lower rocket portion 320 shown in FIG. 3 can detach from the upper rocket portion 310 to aid in refilling the water vessel. FIG. 3 also shows an upper and lower connection element for interlocking the rocket (water emitting target) with the target framework. The upper connection element 370 is a spherical shaped extrusion that joins with a complementary slot at the connection point 185. The slot is configured to press the top of the extrusion into receiving port which allows, in one embodiment, a predetermined amount of water to flow to the water vessel within the water emitting target. The slot/extrusion juncture is configured to interlock the water emitting target to the target framework until dislodged by an impact from a flying object. The slot is directed toward the participants thus upon impact the water emitting target is dislodged from the target framework toward the game participants.

The lower rocket portion 320 also includes a lower connection element 375 extrusion that joins with a connection point 185 on the horizontal structure 120 to interlock the water emitting target with the target framework. As with the upper connection element, the lower connection element fluidically couples the water emitting target to the horizontal structure to allow transfer of water from the water source to the water vessel in the water emitting target. Upon the transfer of a predetermined amount of water to the water emitting target, the valve closes readying the target for game play.

In other embodiments of the present invention the water emitting target can be interlocked (coupled) to the target framework with mechanical hooks, loops, switches, magnets, springs, cables and any other means of detachably interlocking one object to another. While one or more versions of present invention include the ability to fluidically couple the water emitting target to the target framework, other versions simply interconnect the water emitting target to the target framework with no fluidic connection.

Upon impact from a flying object the water emitting target is dislodged from the horizontal structure in a direction toward the game participants. At impact or as the target falls, water can spray on the participants who are actively trying to catch the target before it hits the ground. In another embodiment of the invention, the valve used to fill the water vessel recognizes that the water emitting target has been dislodged. As a result another predetermined amount of water is released, but as there is no longer a water emitting target interlocked (coupled) at the connection point, the water sprays out of the valve and likely impacts the nearby participants adding to the enjoyment of the game.

One embodiment of the present invention is for a kit for playing a water emitting outdoor game. Such a kit includes a target framework, and at least one water emitting target adapted to detachably interlock with the target framework. The water emitting target also includes a releasable water vessel that can get participants wet as the target is dislodged. The kit further includes at least one object configured to be thrown by a person for detaching (dislodging) the water emitting target from the target framework when the object strikes the target and detaches it from the framework.

The objects thrown at the water emitting targets can take many forms. In one embodiment the object is a flying disk, while in another the object can be a bean bag. In yet another, a soft arrow or foam bullet can be thrown or shot at the water emitting target, and in yet another embodiment, additional water emitting targets themselves can be tossed at the framework in hopes to dislodge the interlocked water emitting targets.

Figure 4:
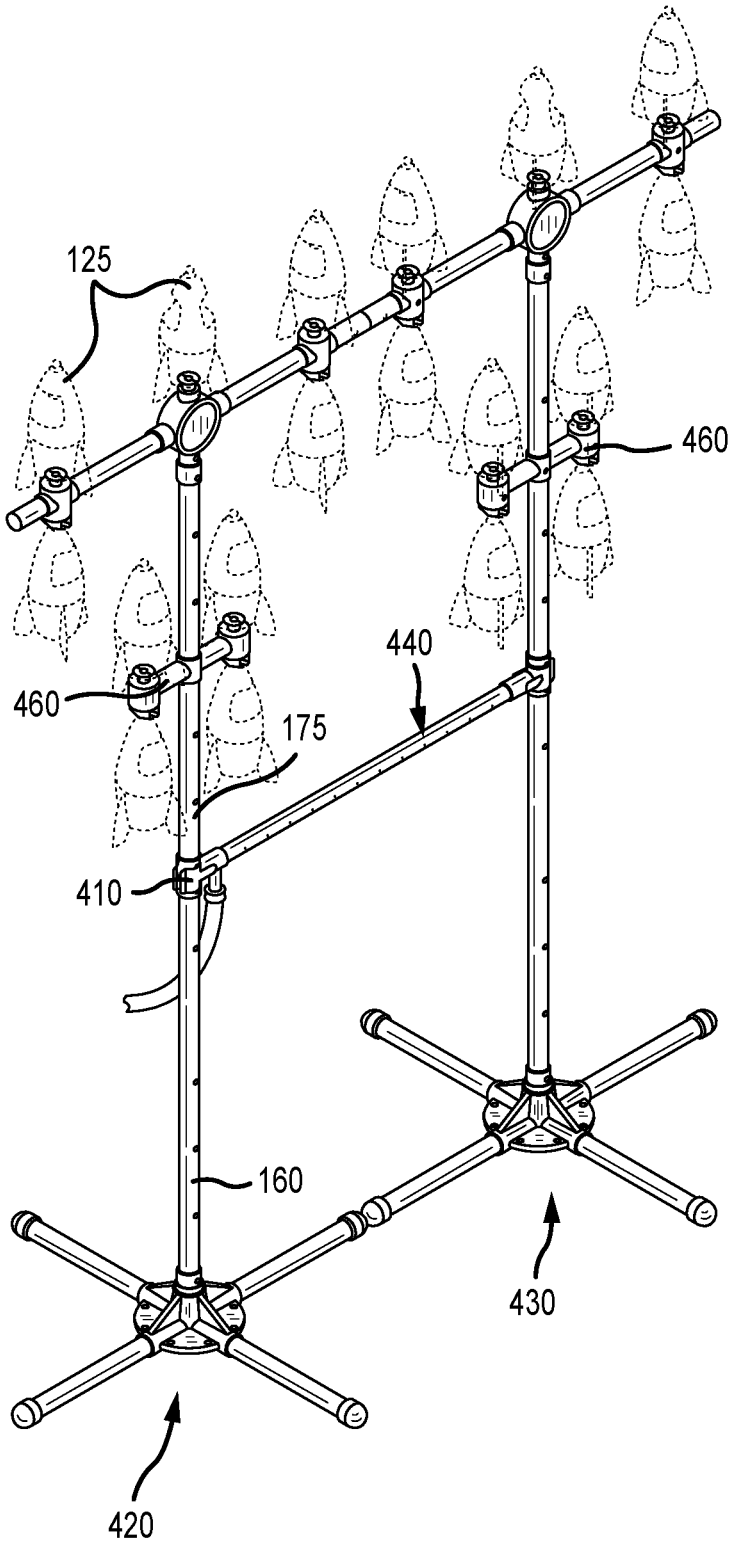
FIG. 4 is a perspective view of an expanded target framework and a plurality of water emitting targets, according to another embodiment of the present invention.

The kit of the present invention also enables the participants to expand the target framework to accommodate additional water emitting targets and additional participants. The vertical structure components and the horizontal structure components are modular allowing for a simple "T" configuration of the invention be expanded. FIG. 4 is a perspective view of an expanded target framework for a water emitting outdoor game according to one embodiment of the present invention.

In the rendition shown in FIG. 4 a "T" fitting 410 is used to join the lower vertical structure 160 with the upper vertical structure 175 of the left-most target structure 420. Similarly, a "T" fitting is used to join the lower vertical structure with the upper vertical structure of the right-most target structure 430. The water source attachment point on the right-most target framework is capped while a water source is coupled to the left-most target framework. A cross connector 440, configured to transport water from the left-most target framework to the right-most target frame is connect to each "T" fitting.

Similarly, one of the horizontal components of the left-most target structure 420 is fluidically coupled to one of the horizontal components of the right-most target structure 430. The result is an expanded target framework that, in this embodiment, can present 10 water emitting targets 125. Moreover, additional water emitting targets can be added to the target frame work by adding additional connection points 460.

FIG. 4 shows two such additional connection points 460, one on the left-most target framework and one on the right-most target framework. Each additional connection point can house 4 additional water emitting targets.

The modular design of the present invention enables the user to craft numerous configurations of a target framework for a water emitting outdoor game. By obtaining additional components the target framework its versatility can be expanded to accommodate any number of participants.

Figure 5:
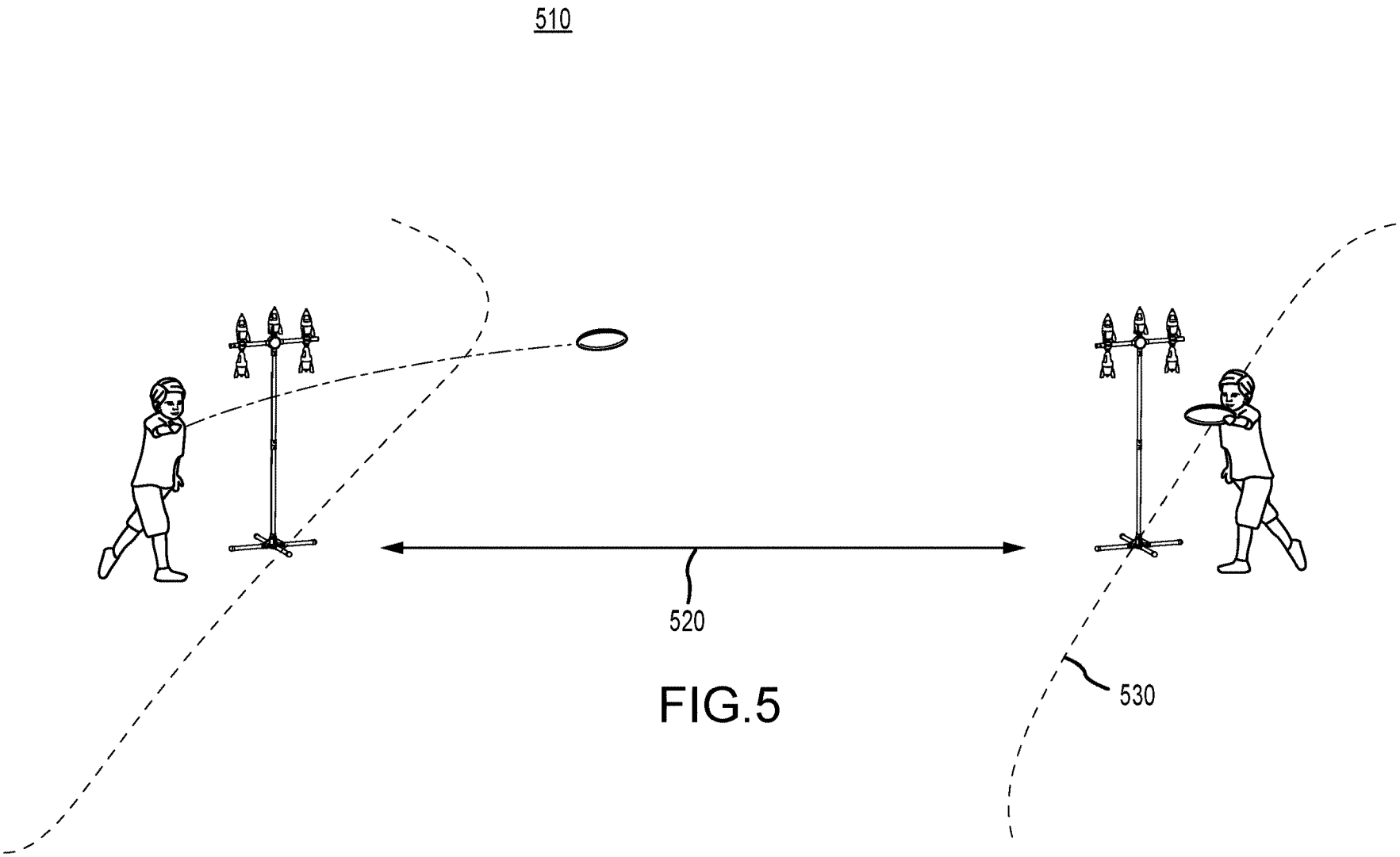
FIG. 5 is a high level view of an environment using a water emitting game apparatus according to one embodiment of the present invention.

The water emitting outdoor game target framework, and associated water emitting targets, is a social game played by two opposing parties. The game can be played by two individuals or by two teams, each comprised of multiple individuals. FIG. 5 depicts an environment 510 in which a water emitting outdoor game of the present invention can be played.

The game environment includes at least one target framework and two teams positioned opposite each other. One team is designated as a first, or receiving team, and the other is the second, or throwing team. FIG. 5 shows an environment having two target frameworks, but the game can be played with one target framework by simply changing the position of the receiving and throwing teams.

The first and second teams are positioned in a facing relation to each other separated by a predetermined distance 520. Set up for the game continues by placing a target framework, complete with a plurality of water emitting targets, proximate to the first team. The target framework is between the first and second teams. Said differently, the first team is positioned close to, but behind the target framework in relation to the second team.

As a flying object is tossed toward the target framework by the second team in an attempt to hit and detach a water emitting target from the target framework, the first team stands ready and nearby 530 the target framework, yet behind the target framework, to either catch any detached water emitting target before it hits the ground or catch the flying object should it miss the target framework entirely.

Each teach can possess a plurality of flying objects and in other embodiments of the game, any detached flying object that is caught by the opposing team can be used to toss back toward the other team.

Figure 6:
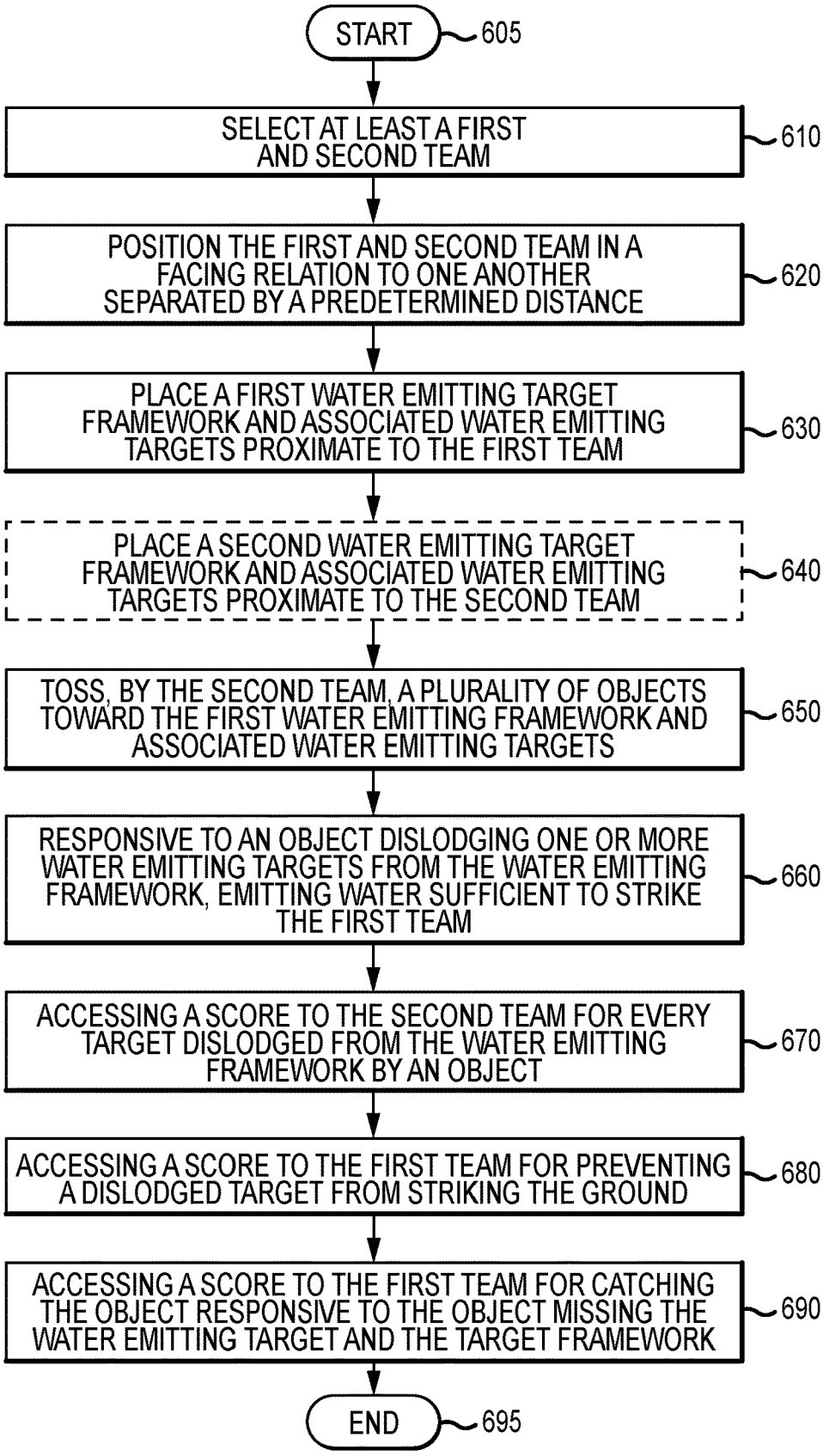
FIG. 6 is a methodology according to the present invention for playing a game having a water emitting game apparatus.

FIG. 6 is a flowchart of one method, according to the present invention, for playing a game having a water emitting game apparatus according to the present invention. As mentioned above one or two target frameworks are positioned apart from each by a predetermined distance. Two teams are thereafter selected 610 and each positioned 620 proximate 630 to, but behind, their respective target framework in a facing relation to one another.

In one embodiment of the present invention a first team is proximate to and defends its target framework 630 receiving the flying objects. The second team proximate to the second target frame work 640 tosses/throws 650 on or more objects (disks, rockets, bean bags, etc.) toward the first team's target framework with hopes to hit and detach one or more water emitting targets. Assessing points occurs based on detaching a target or catching the flying object.

Responsive to a water emitting target becoming dislodged (detached) 660 from the target framework, water is emitted from the water emitting target and/or the target framework sufficient to impact the first team. The team striking a target, and/or the target framework, and causing one or more of the targets to become detached is assessed 670 a first score of points.

At the same time the first or receiving team stands ready to catch any detached water emitting target with the objective to prevent it from reaching the ground 680 or simply catch the flying object should it miss the target framework entirely and be assessed 690 a second score. In one embodiment of the present invention, catching a detached water emitting target is assessed more points than is gained from impacting the target framework or target itself causing it to be detached. Accordingly, the receiving team is motivated to stay close to the target framework and within a region that, upon impact, they are likely to get wet.

The game can continue until a predetermined number of points is reached or when all of the water emitting targets associated with one team's target framework are detached 695 ending the game. The game described above can have, and is contemplated to have, numerous variations consistent with the central concept of an enjoyable social outdoor game involving water. For example, should a team catch a flying object after it misses the intended target framework, that team can not only gain points for its efforts to catch the object, but use it to toss back toward the opponents target framework.

In another embodiment of the present invention a single target framework can be sued and the two teams can rotate their relative positions. The target framework can also be used singularly for accuracy training or simply to compete between two or more individuals based on who hits more targets.

While there have been described above the principles of the present invention in conjunction with a water emitting outdoor game apparatus, kit and methodology, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

The invention claimed is:

1. A kit for playing a water emitting outdoor game, the kit comprising:

at least one target framework, wherein the target framework includes a base, a vertical support structure and a horizontal structure coupled to the vertical structure apart from the base;

at least one water emitting detachable target adapted to interlock with the horizontal structure and adapted to detach in its entirety from the at least one target framework wherein the at least one water emitting detachable target includes a releasable water vessel and; and at least one object configured to be thrown by a person to detach the at least one water emitting detachable target from the target framework responsive to the object striking the at least one water emitting detachable target and wherein detaching the at least one water emitting detachable target from the target framework in its entirety releases water from within the releasable water vessel.

2. The kit for playing a water emitting outdoor game according to claim 1, wherein the target framework is adapted to couple to a water source and emit water from the water source responsive to an impact from one of the one or more objects and detaching the at least one water emitting detachable target from the at least one target framework.

3. The kit for playing a water emitting outdoor game according to claim 1, wherein the horizontal structure coupled to the vertical structure is adapted to interlock with the at least one water emitting detachable targets above and/or below the horizontal structure and wherein the vertical structure and horizontal structure are adapted to transport water from a water source to the at least one water emitting detachable targets.

4. The kit for playing a water emitting outdoor game according to claim 1, wherein the target framework is adapted to supply water to the water vessel of the at least one water emitting detachable target responsive to the at least one water emitting detachable target interlocking with the target framework.

5. The kit for playing a water emitting outdoor game according to claim 1, wherein the target framework is configured to couple with an additional target framework.

6. The kit for playing a water emitting outdoor game according to claim 1, wherein the object is a flying disk.

7. The kit for playing a water emitting outdoor game according to claim 1, wherein the object is a detached at least one water emitting detachable target.

8. The kit for playing a water emitting outdoor game according to claim 1, further comprising an area proximate to the at least one target framework within which players must stand.

9. A water emitting game apparatus coupled to a water source intended for use by at least two teams, the apparatus comprising:

a target framework having a base, a vertical support structure connected to the base and adapted to couple with the water source, and a horizontal structure coupled to the vertical structure apart from the base; and at least one water emitting detachable target adapted to interlock with and detach in its entirety with the horizontal structure of the target framework wherein the at least one water emitting detachable target includes a releasable water vessel that upon impact from a flying object and detaching from the target framework releases water from the releasable water vessel.

10. The water emitting game apparatus of claim 9, further comprising a valve coupled to the target framework and adapted to supply water from the water source to the releasable water vessel within the water emitting detachable target when interlocked with the target framework.

11. The water emitting game apparatus of claim 10, wherein the valve is adapted to spray water for a predetermined period of time responsive to the at least one water emitting detachable target detaching from the target framework.

12. The water emitting game apparatus of claim 9, wherein the at least one water emitting target includes a male fitting and wherein the target framework includes a female fitting adapted to couple with the male fitting to interlock the at least one emitting target to the target framework and further adapted to detach the at least one water emitting target from the target framework in its entirety in a predetermined direction upon impact from the flying object.

* * * * *